US005996667A

United States Patent [19]

Fun

[11] Patent Number: 5,996,667

[45] Date of Patent: Dec. 7, 1999

[54] WINDOW BLIND

[76] Inventor: Fu-Mei Fun, No. 103, Her Tsuoh Street, Shi Tun Area, Taichung City, Taiwan

[21] Appl. No.: 09/248,977

[22] Filed: Feb. 12, 1999

[51] Int. Cl.[6] ..... A47H 5/02

[52] U.S. Cl. ..... 160/84.01; 160/170 R; 242/125.1; 242/587.1

[58] Field of Search ..... 160/170 R, 84.01, 160/168.1 R; 242/128.1, 587.1, 587; 24/129 R, 130, 136 L

[56] References Cited

U.S. PATENT DOCUMENTS 2,758,644 8/1956 Virlouvet ..... 160/170 R
5,092,382 3/1992 Fluckiger ..... 160/170 R

FOREIGN PATENT DOCUMENTS 79231 2/1961 France ..... 160/170
2107716 8/1972 Germany ..... 160/170

*Primary Examiner*—Blair M. Johnson
*Attorney, Agent, or Firm*—Dougherty & Troxell

[57] ABSTRACT

A window blind, which includes a track; a blind suspended from the track; a plurality of blind take-up mechanisms respectively mounted inside the track, each blind take-up mechanism including a spool holder securely mounted inside the track, a spool revolvably supported on the spool holder, at least one positioning element detachably fastened to the spool, and a lift cord having a top end fastened to one positioning element at the spool and a bottom end fastened to the blind for enabling the blind to be taken up/let off upon rotary motion of the spool; and a control unit securely mounted on the track at one end for operation by hand to rotate the spools of the blind take-up mechanisms through a transmission rod thereof, for enabling the blind to be lifted or lowered.

8 Claims, 5 Drawing Sheets

WINDOW BLIND

BACKGROUND OF THE INVENTION

The present invention relates to a window blind, and more particularly to such a window blind in which the blind can easily be detached from the track for washing.

A regular window blind, as shown in FIG. 1, is generally comprised of a track 12, a blind 13 suspended from the track 12, a plurality of blind take-up mechanisms 14 respectively mounted inside the track 12, a control unit 15 provided at one end of the track 12 and operated to drive the blind take-up mechanisms 14, causing the blind take-up mechanisms 14 to take up/let off the blind 13. The blind take-up mechanisms 14 each comprise a lift cord 16 fastened to a respective retaining ring 17 at the bottom end of the blind 13. Because the top end of each lift cord 16 is fastened to the respective blind take-up mechanism 14, each lift cord 16 must be unfastened from the respective blind take-up mechanism 14 before removing the blind 13 from the track 13 for washing. On the contrary, after installation of the blind 13, the top end of each cord 16 must be fastened to the respective blind take-up mechanism 14. This installation procedure is complicated. Furthermore, because the cords 16 are respectively tied to the blind take-up mechanisms 14, they may be loosened from the blind take-up mechanisms 14. In case the cords 16 are not fastened to the blind take-up mechanisms 14 at equal length, the bottom end of the blind 13 will be tilted in one direction.

SUMMARY OF THE INVENTION

The present invention has been accomplished to provide a window blind which eliminates the aforesaid drawbacks. It is one object of the present invention to provide a window blind which can easily be installed. It is another object of the present invention to provide a window blind which enables the user to detach the blind from the track conveniently. According to the present invention, the window blind comprises a track; a blind detachably fastened to the track by loop and hook materials; a plurality of blind take-up mechanisms respectively mounted inside the track, each blind take-up mechanism comprising a spool holder securely mounted inside the track, a spool revolvably supported on the spool holder, at least one positioning element detachably fastened to the spool by a plug joint; a lift cord having a top end fastened to one positioning element at the spool and a bottom end fastened to the blind for enabling the blind to be taken up/let off upon rotary motion of the spool; and a control unit securely mounted on the track at one end for operation by hand to rotate the spools of the blind take-up mechanisms through a transmission rod thereof, for enabling the blind to be lifted or lowered. This design achieves the following advantages.

1. When dismounting the blind, the positioning elements can be directly pulled away from the respective spools; on the contrary, the positioning elements are fastened to the respective spools during installation of the blind.

2. It is not necessary to fasten or unfasten the lift cords during mounting/dismounting of the blind.

3. Because the lift cords are maintained connected between the respective positioning elements and the retainer rings at the blind, the blind is automatically maintained in balance after its installation.

4. Because the lift cords are constantly maintained connected to the blind, the connection between the lift cords and the blind can be achieved by any fixation method.

DETAILED DESCRIPTION OF THE PREFERRED EMBODIMENT

Figure 1:
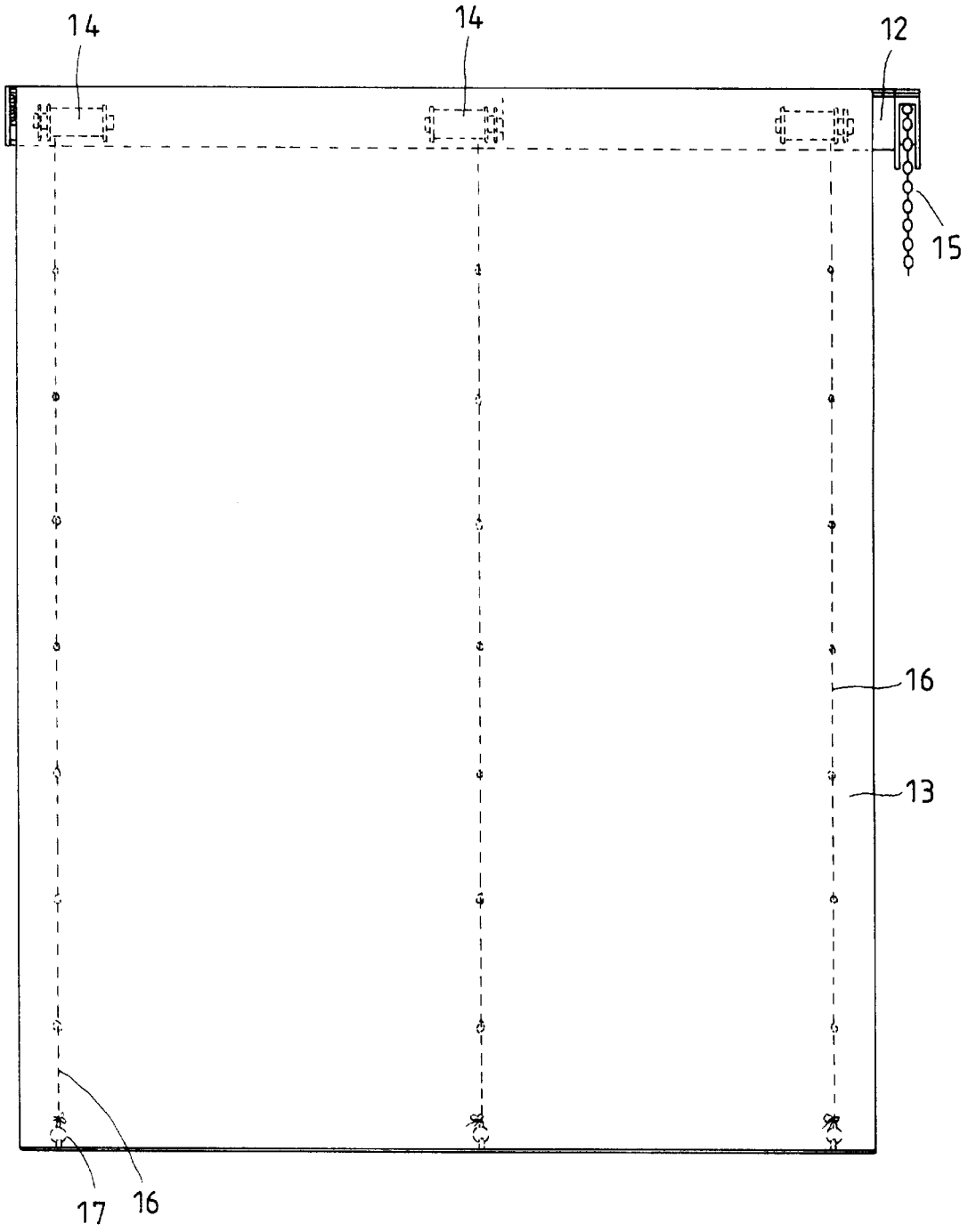
FIG. 1 PRIOR ART
FIG. 1 illustrates a window blind according to the prior art.

Referring to FIGS. from 2 through 6, a window blind 20 in accordance with the present invention is generally comprised of a track 30, a plurality of blind take-up mechanisms 40, a control unit 60, and a blind 70.

Figure 2:
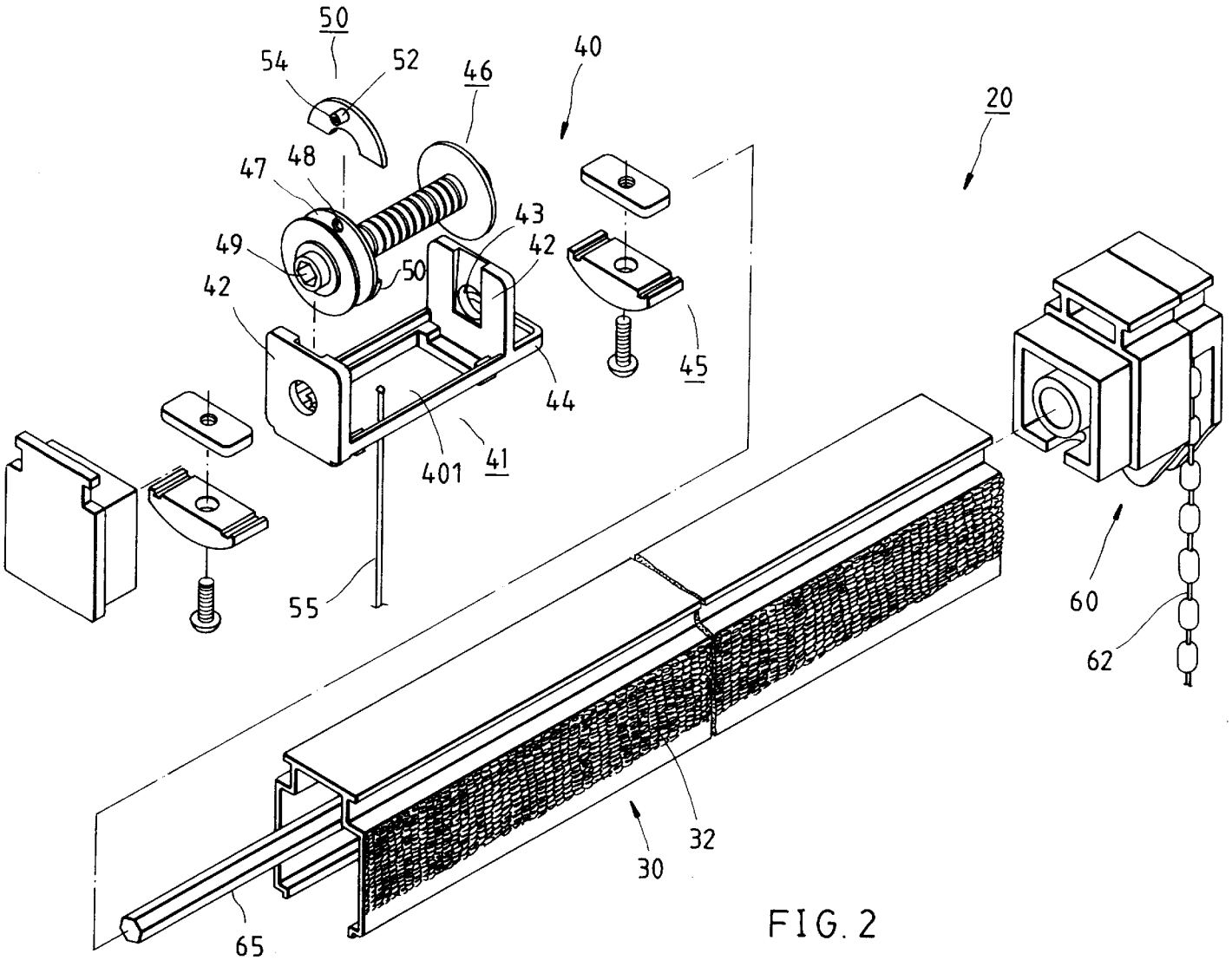
FIG. 2 is an exploded view of a window blind according to the present invention (the blind excluded).

The structure and shape of the track 30 are not within the scope of the present invention. The design of the track 30 shown in FIG. 2 is just an example of the present invention.

Figure 4:
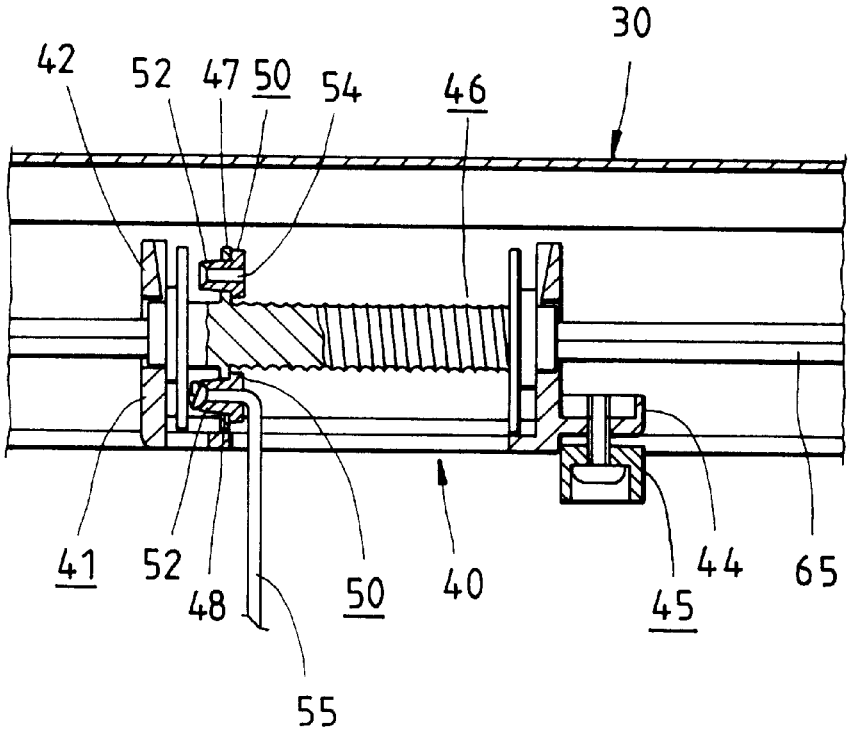
FIG. 4 is a sectional view of a part of the present invention, showing the blind take-up mechanism mounted inside the track.
Figure 5:
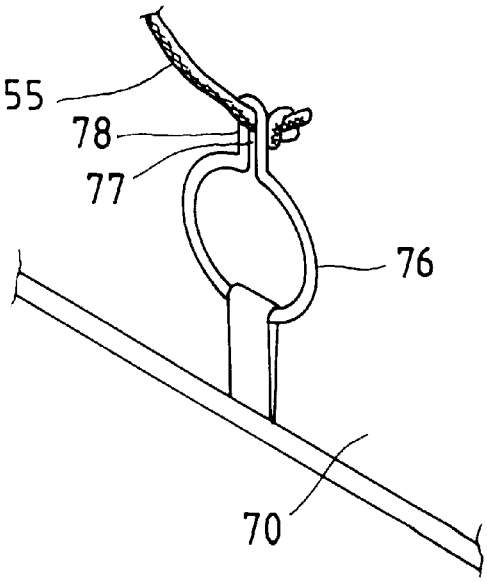
FIG. 5 is an enlarged view of a part of the present invention, showing the bottom end of the lift cord securely fastened to the retaining hole in the protruded portion of the respective retainer ring at the blind.

The blind take-up mechanisms 40 are mounted inside the track 30, each comprised of a spool holder 41, a spool 46, two arched positioning elements 50, and a lift cord 55. The spool holder 41 comprises two upright lugs 42 arranged in parallel at two opposite ends thereof, the upright lugs 42 each defining a pivot hole 43, an opening 401 through its bottom wall between the upright lugs 42, and a mounting flange 44 extended from one end thereof. The mounting flange 44 is fastened with a fitting 45 to a part inside the track 30 by for example a screw. The installation of the spool holder 41 in the track 30 may be variously embodied. The spool 46 is mounted in the pivot holes 43 between the upright lugs 42, and rotated to take up/let off the blind 70. A disk-like locating means 47 is formed integral with the periphery of the spool 46 near its one end. Retaining means for example retaining holes 48 are symmetrically provided at the disk-like locating means 47. The two arched positioning elements 50 are abutted against each other around the spool 46, and respectively fastened to the disk-like locating means 47 at one side. Each positioning element 50 has a plug rod 52 press-fitted into one retaining hole 48 at the disk-like locating means 47, and a wire hole 54. The wire hole 54 is preferably formed through a central axis of the plug rod 52. The lift cord 55 has a first end securely fastened to the wire hole 54 at one arched positioning element 50 (see FIG. 4), and a second end fastened to the blind 70.

The control unit 60 is mounted on the track 30 at one end, having a control member 62 pulled to rotate a rod 65 in the track 30. The control member 62 can be a lift cord or string of beads. The rod 65 is inserted through the axial center through hole 49 at the spool 46 of each blind take-up mechanism 40. By means of controlling the control member 62 to rotate the rod 65, the spools 46 of the blind take-up mechanisms 40 are synchronously rotated to take up the lift cord 55.

Figure 3:
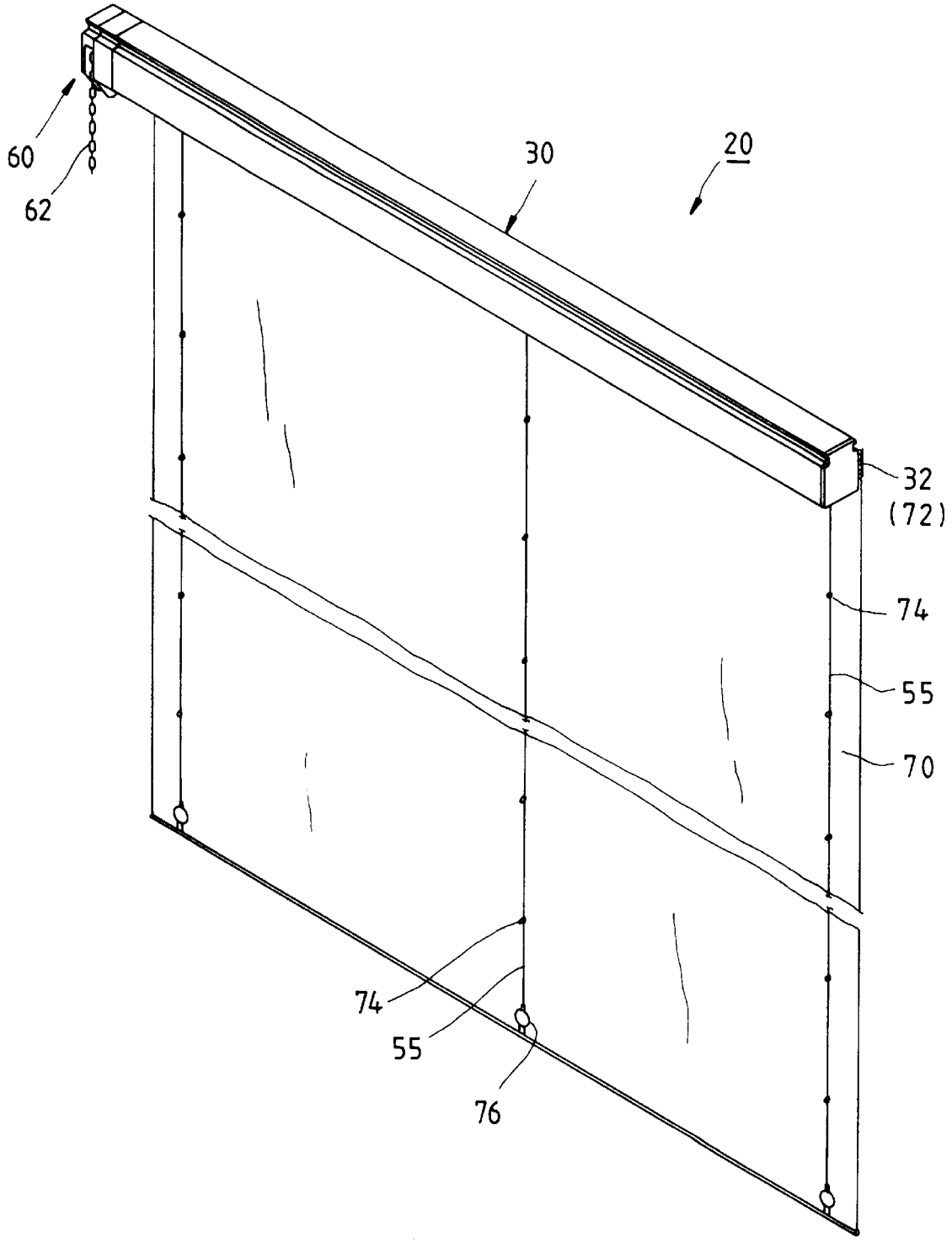
FIG. 3 is a rear elevational view of the window blind showing the blind lowered according to the present invention.

The blind 70 comprises a tape of loop (or hook) material 72 at its top end detachably secured to a tape of hook (or loop) material 32 at the track 30 (see FIG. 3), longitudinal rows of cord loops 74 arranged in parallel at its one side, and a plurality of retainer rings 76 respectively disposed at its bottom end in alignment with the rows of cord loops 74. The retainer rings 76 each comprise a protruded portion 77 defining a retaining hole 78. The second end of each lift cord 55 is inserted through one row of cord loops 74, and securely fastened to the retaining hole 78 at the protruded portion 77 of one retainer ring 76. Therefore, the blind 70 is lifted when the spools 46 of the blind take-up mechanisms 40 are rotated with the rod 65 to take up the lift cords 55.

Figure 6:
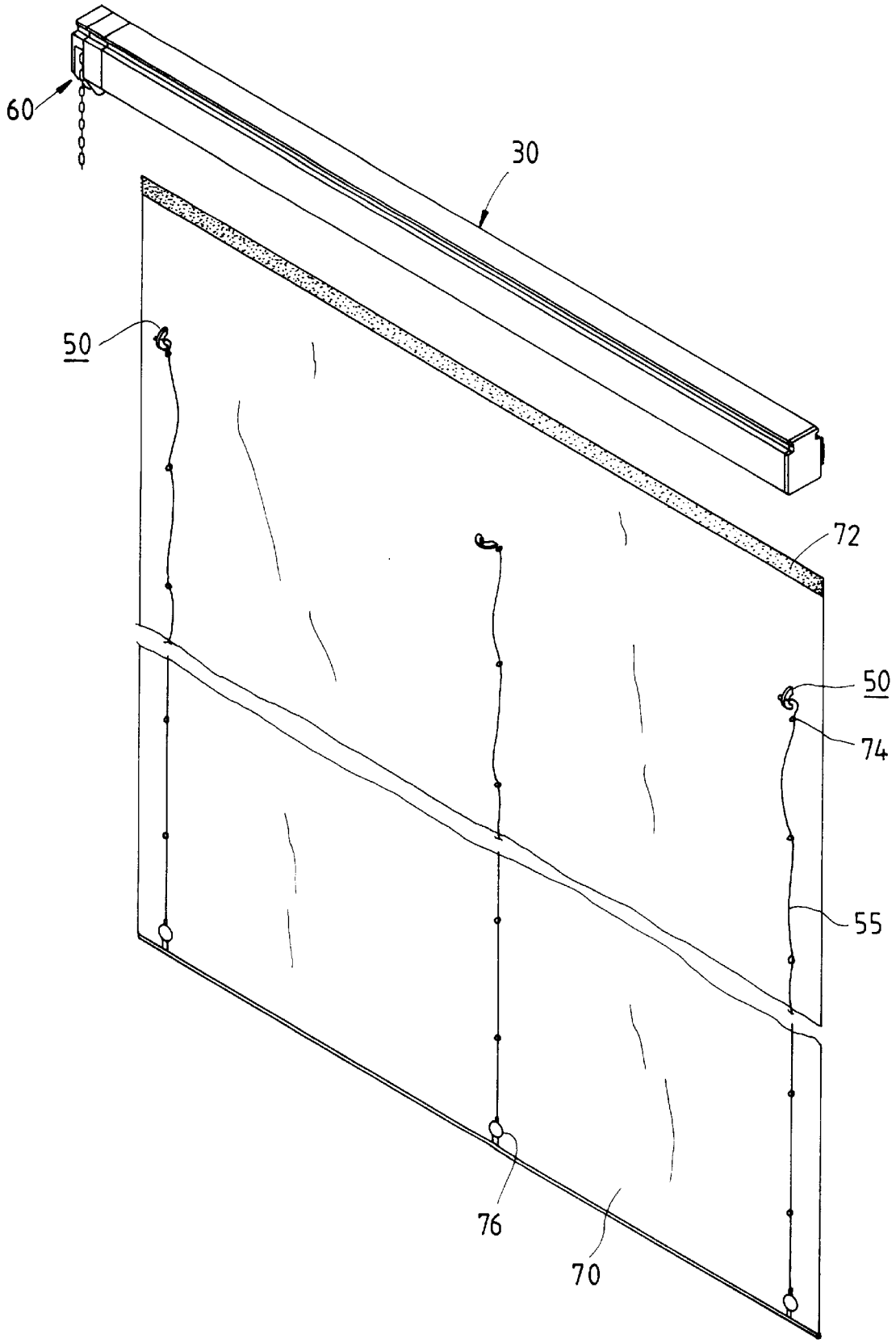
FIG. 6 shows the blind detached from the track.

When not in use, the control member 62 is operated to let off the lift cords 55, thereby causing the blind 70 to be lowered. After the blind 70 has been lowered, the lift cords 55 are then pulled to disconnect the respective arched positioning elements 50 from the disk-like locating means 47 of the respective spools 46, and then the blind is detached from the tape of hook (or loop) material 32 at the track 30 (see FIG. 6). When detached, the detached arched positioning elements 50 are still fixedly secured to the top ends of the lift cords 55 and stopped at the rows of cord loops 74 at the top side, and the bottom ends of the lift cords 55 are maintained retained firmly to the retainer rings 76 at the bottom end of the blind 70, therefore the lift cords 55 are maintained retained firmly to the blind 70. Therefore, the user can wash the lift cords 55 and the blind 70 simultaneously.

When installing the blind 70, the tape of loop (or hook) material 72 at the blind 70 is fastened to the tape of hook (or loop) material 32 at the track 30, and the respective arched positioning elements 50 are fastened to the disk-like locating means 47 of the respective spools 46 again.

While only one embodiment of the present invention has been shown and described, it will be understood that various modifications and changes could be made thereunto without departing from the spirit and scope of the invention disclosed.

What is claimed is:

1. A window blind comprising:

a track;

a blind suspended from said track;

at least one blind take-up mechanism mounted inside said track, said at least one blind take-up mechanism comprising a spool holder securely mounted inside said track, and a spool rotatable supported in said spool holder;

a lift cord having a top end and a bottom end fastened to said blind;

a control unit securely mounted on said track and having a transmission rod engaged with the spool whereby rotation of the transmission rod by the control unit causes rotation of the spool; and, at least one positioning element attached to the top end of the lift cord and detachably fastened to one end portion of the spool by a press-fit plug joint to thereby removably attach the top end of the lift cord to the spool, such that rotation of the spool lifts or lowers the bottom end of the blind.

2. The window blind of claim 1 wherein the spool of said at least one blind take-up mechanism further comprises a locating means engaged by said plug joint of said blind take-up mechanism for removably attaching the top end of the lift cord to the spool.

3. The window blind of claim 2 wherein said locating means comprises a disk-like locating member.

4. The window blind of claim 1 wherein the spool of said at least one blind take-up mechanism comprises at least one female retaining means, and the at least one positioning element comprises a male retaining means removably engaging the at least one female retaining means on the spool of the at least one blind take-up mechanism.

5. The window blind of claim 3 wherein said plug joint comprises a plug hole in said disk-like locating member, and a plug rod extending from said at least one positioning element removably engaging said plug hole.

6. The window blind of claim 1 comprising a plurality of take-up mechanisms mounted in said track and spaced apart from each other, the transmission rod engaging all of the spools of the plurality of take-up mechanisms.

7. The window blind of claim 5 wherein each of the at least one positioning element comprises an arcuate shaped member having the plug rod extending from one side thereof.

8. The window blind of claim 1 further comprising a strip of hook and loop fastening material attached to the track and to a top of the blind to removably attach the blind to the track.

* * * * *